US006123575A

United States Patent [19]

Huang et al.

[11] Patent Number: 6,123,575

[45] Date of Patent: Sep. 26, 2000

[54] ELECTRICAL CARD CONNECTOR WITH MIXED LATCHING MEANS

[76] Inventors: Wayne Huang; An-Jen Yang, both of 1650 Memorex Dr., Santa Clara, Calif. 95050

[21] Appl. No.: 09/364,834

[22] Filed: Jul. 30, 1999

[51] Int. Cl.[7] ..... H01R 13/627

[52] U.S. Cl. ..... 439/489; 439/352

[58] Field of Search ..... 439/489, 350–358

[56] References Cited

U.S. PATENT DOCUMENTS

| | | | |
|---|---|---|---|
| 4,857,008 | 8/1989 | Kee et al. | 439/352 |
| 5,219,300 | 6/1993 | Yagi et al. | 439/352 |
| 5,254,014 | 10/1993 | Yagi et al. | 439/357 |
| 5,330,366 | 7/1994 | Tsuji et al. | 439/352 |
| 5,480,313 | 1/1996 | D'Alayer De Costemore D'Arc | 439/352 |
| 5,498,171 | 3/1996 | Semaan | 439/352 |
| 5,830,001 | 11/1998 | Kinoshita et al. | 439/354 |

*Primary Examiner*—Gary F. Paumen

[57] ABSTRACT

An electrical card connector for electrically coupling with an external plug, includes an insulative housing that receives a plurality of contacts and a pair of mixed latching means therein. Each mixed latching means consists of a spring bar with a protrusion extending integrally with the housing, and a metallic spring buffer disposed inside the housing. Each spring buffer includes a spring arm portion preloaded by the spring bar at a first supporting section thereof, a second supporting section formed at a free end of the spring arm portion and spaced apart from a stopper wall formed on the housing thereby constructing the spring arm portion as a cantilevered beam. After the spring bar is progressively deformed to reach a specific deformation due to the coupling between the plug and connector, the second supporting section of the spring arm portion can abut against the stopper wall to transform the spring arm portion as a simple support beam. Therefore, a maximum resilient force is exercised by the spring arm portion on the spring arm to have the protrusion suddenly snap with a notch formed on the plug so as to create a resounding audio effect to inspect the locking status between the mated connector and plug.

13 Claims, 6 Drawing Sheets

ELECTRICAL CARD CONNECTOR WITH MIXED LATCHING MEANS

BACKGROUND OF THE INVENTION

1. Field of the Invention

The present invention relates to a connector for use with an electrical card, and particularity to a miniature connector for electrically coupling with an external plug connector.

2. The Prior Art

In a conventional electrical connector assembly including a plug connector and a receptacle connector, both connectors with a plurality of contacts are capable of being mutually mated thereby establishing an electrical connection or signal transmission between both connectors. And, the reliable electrical connection between the mated connectors has to rely on the sufficient retention relationship between the complementary latch means respectively formed on both connectors. However, it is extremely difficult to observe or inspect whether the retentive relationship between the complementary latch means is secure and sufficient or not, especially in a miniature type connector.

Other designs on the latch means adopt a voice or a snapping effect to inspect the retention status. Most of the audio inspections are achieved by the press-fit between the complementary latching means of the mated connectors. As the disclosure in FIG. 6 of U.S. Pat. No. 5,830,001, a plug 3 and a receptacle 5 are firmly mated by means of coupling between a notched engaging portion 33 of the plug 3 and a first protrusion 53*a* formed on each plastic engaging portion 53 of the receptacle 5. However, an overly tight fit between the mated connectors or a long-term fit easily damages the plastic engaging portion 53, i.e. a permanent deformation. Oppositely, a loose fit therebetween is hard to result in a voice or a snapping effect for inspection of the retention status. As to U.S. Pat. No. 5,830,001, the bar-like engaging portion 53 must remain in a specific thickness, otherwise either a thicker structure will result in strengthening the rigidity thereof and diminish the elasticity, relatively, or a thinner structure will result in malfunction of the voice effect of the latching means.

The invention relates a connector specialized for a miniature electrical card, i.e. a compact flash card or a PCMCIA card. Such an electrical card is adopted on memory storage or different signal transfer for a computer, a digital visual/audio recorder and player, or a network interface. The connector of the present invention is used to electrically connect a mating connector of an electrical device, like a plug, to the card device.

SUMMARY OF THE INVENTION

Accordingly, one object of the present invention is to provide an electrical card connector a mixed latching means consisting of a plastic spring bar and the metallic spring buffer, obtaining both the rigidity of the plastic material and the elasticity of the metal material.

Another object of the present invention is to provide the electrical card connector with the mixed latching means having the spring buffer in cooperation with a spring bar for prevent the excessive deformation of the spring bar after the electrical card connector is mated with an external plug.

Another object of the present invention is to provide the electrical card connector with the spring buffer in support of the spring bar for ensuring a resounding audio effect to inspect the retention status between the electrical card connector and external plug.

Another object of the present invention is to provide an electrical card connector with the mixed latching means for varying latching forces required in different stages by means of a variable force arm exercised on the spring buffer of the mixed latching means.

To fulfill the above mentioned objects, according to a preferred embodiment of the present invention, an electrical card connector for electrically coupling with an external plug, includes an insulative housing receiving a plurality of contacts and a pair of mixed latching means therein, and a shield attached around the housing. Each mixed latching means consists of an elongated spring bar with a protrusion extending integrally with the housing, and a metallic spring buffer disposed inside the housing. Each spring buffer consists of a spring arm portion preloaded by the spring bar at a first supporting section thereof, a second supporting section formed at a free end of the spring arm portion and spaced apart from a stopper wall formed on the housing thereby constructing the spring arm portion as a cantilevered beam, a bent tail portion restricted inside an alleyway with a swelling defined in the housing, a bight portion extending through an inlet formed between the slot and the alleyway for offering the spring arm portion with a required resiliency, and a planar portion abutting against a lateral wall next to the inlet. After the external plug is inserted into the electrical card connector to progressively impress the protrusion of each spring bar until the spring bar reaches a specific deformation, the second supporting section of the spring arm portion can abut against the stopper wall to transform the spring arm portion as a simple support beam. Therefore, a maximum resilient force is exercised by the spring arm portion on the spring arm to have the protrusion suddenly snap with a notch formed on the external plug so as to create a resounding audio effect to inspect the locking status between the plug and connector.

DETAILED DESCRIPTION OF THE PREFERRED EMBODIMENTS

Detailed reference will now be made to the preferred embodiments of the present invention.

Figure 1:
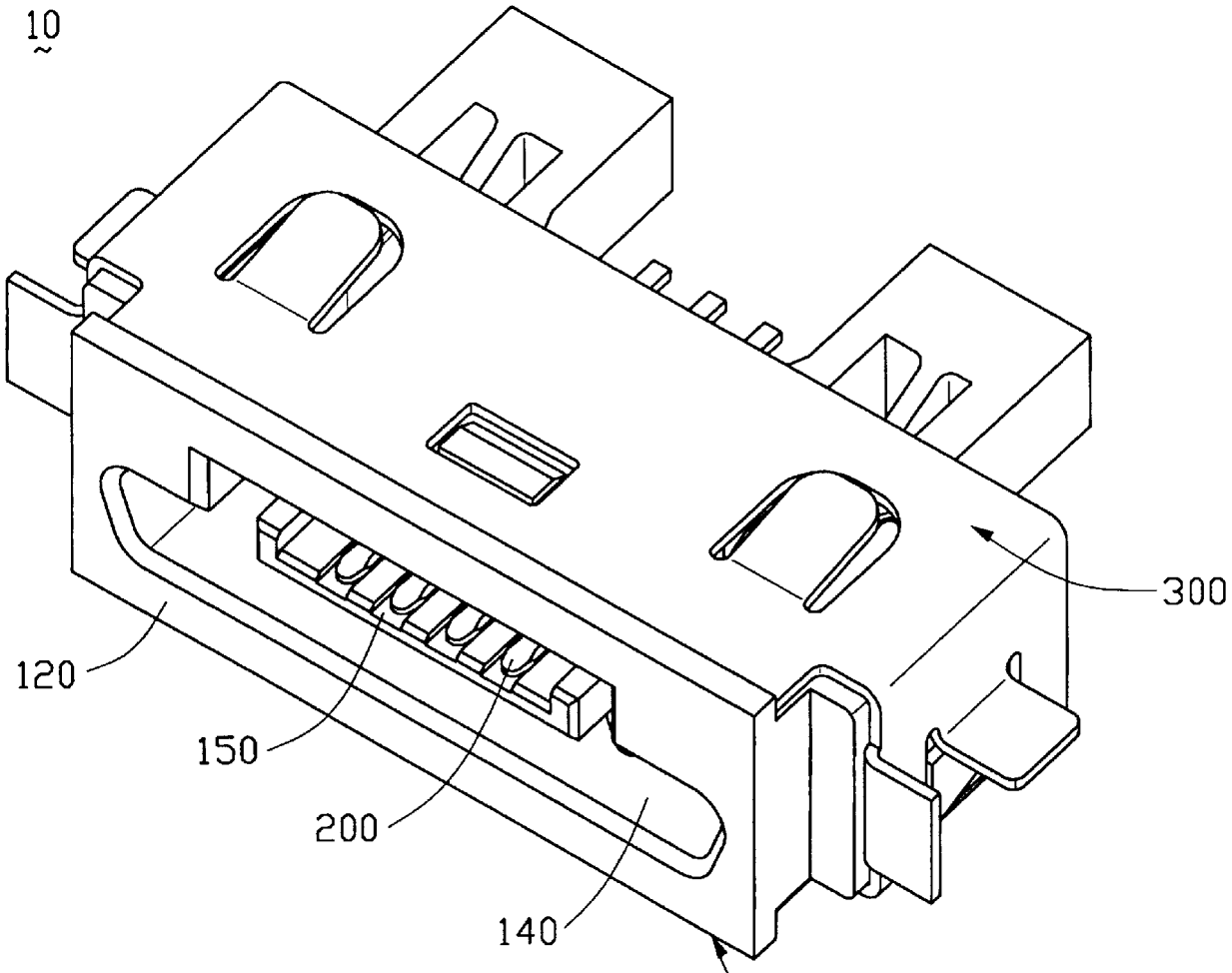
FIG. 1 is a front perspective view of an electrical card connector in accordance with a preferred embodiment of the present invention.

Referring to FIG. 1, an electrical card connector 10 secured to an electrical card (not shown) for coupling an external plug (not shown), consists of an insulative housing 100, a plurality of contacts 200, and a metallic shield 300 disposed around the housing 100. The housing 100 defines a plurality of recesses 150 in a row for reception of the contacts 200 therein, and a cavity 140 through a front surface 120 of the housing to form an opening for permitting the insertion of the external plug therein.

Figure 2:
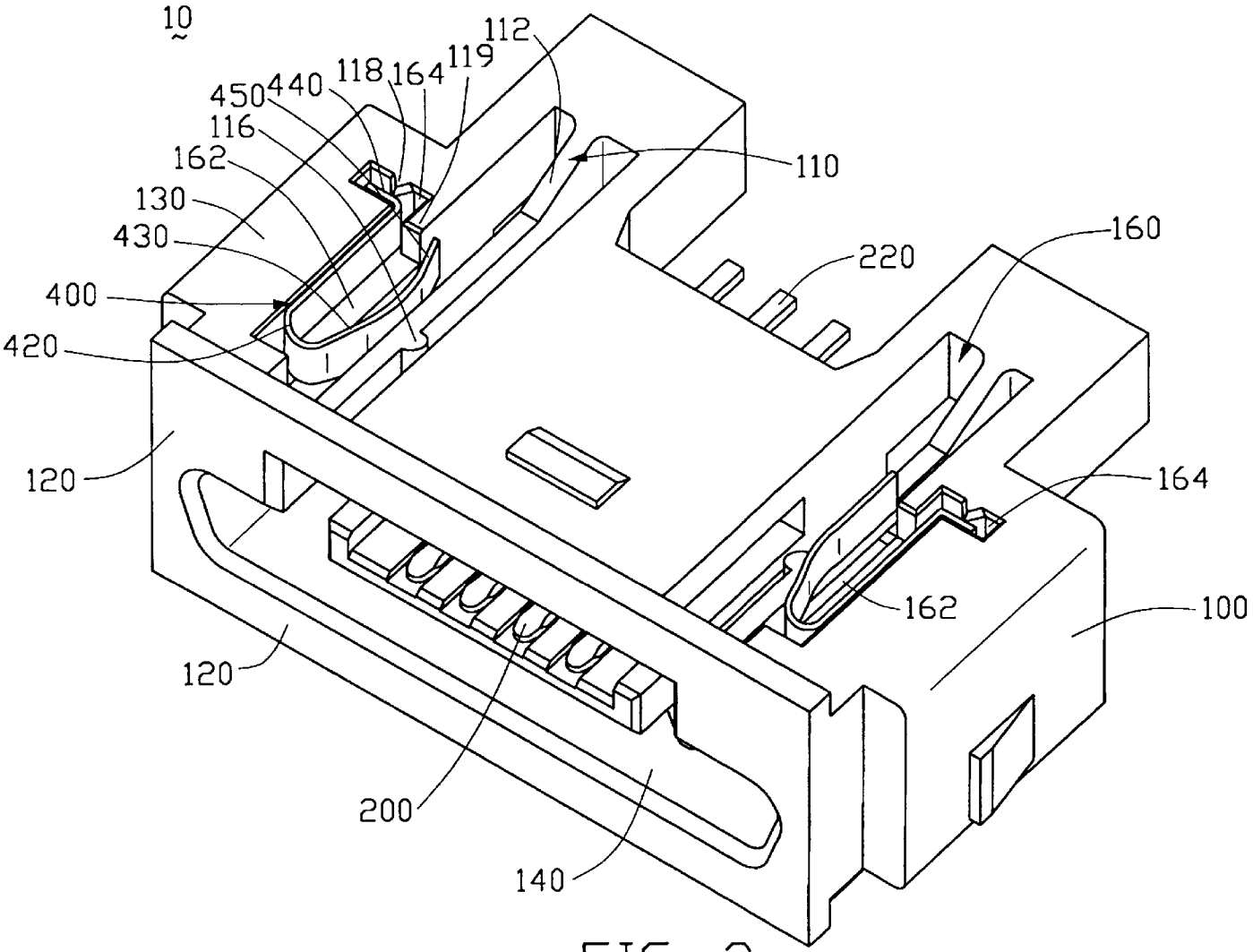
FIG. 2 is another front perspective view of the electrical card connector of FIG. 1 showing that a shield of the connector is dismantled.
Figure 3:
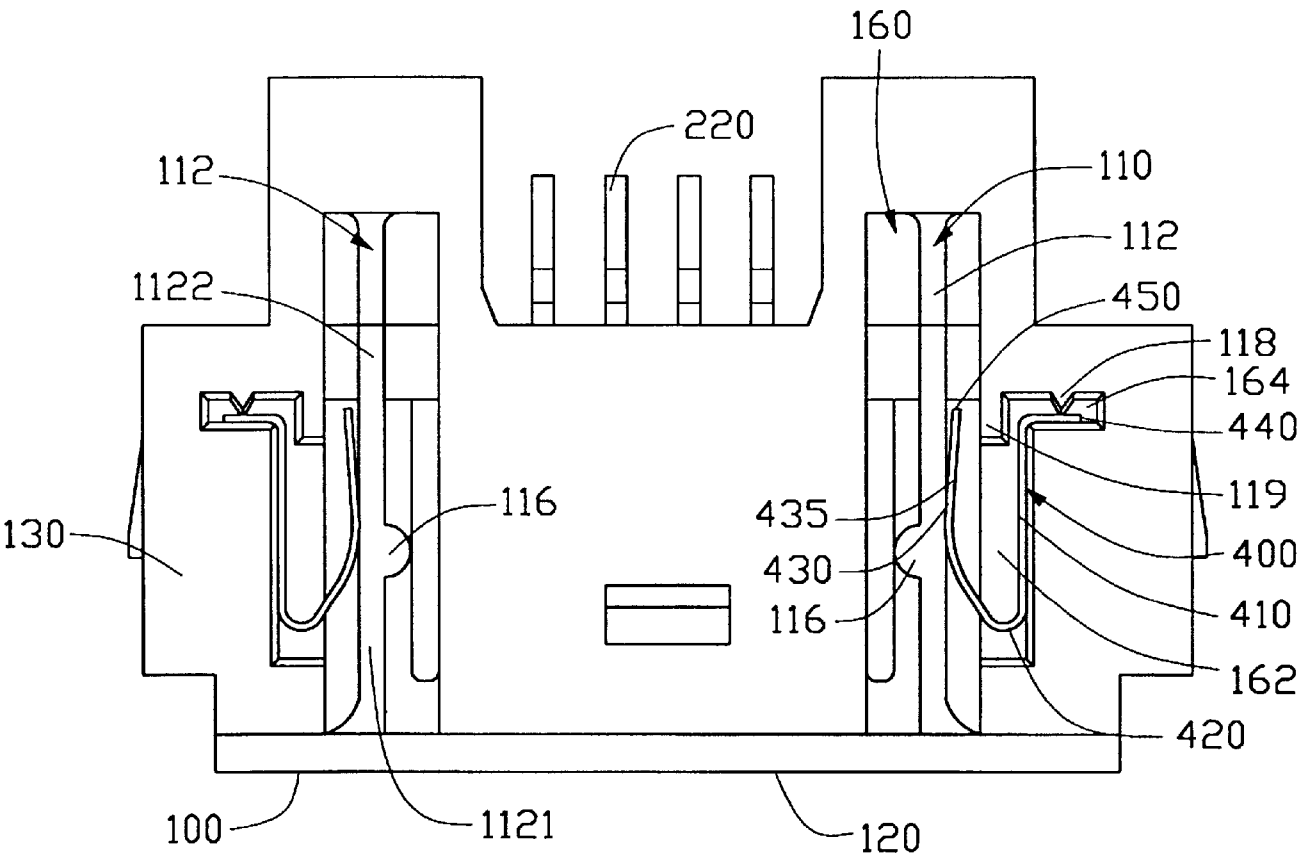
FIG. 3 is a top view of the electrical card connector shown in FIG. 2.

Further referring to FIGS. 2 & 3, the shield 300 of the electrical card connector 10 is dismantled from the housing 100 thereby specifying the inner of the housing 100. Each contact 200 has a soldering tail 220 extending through the cavity 140 of the housing 100 for soldering to a circuit board of the electrical card (not shown). A pair of separated slots 160 are defined through a top wall 130 of the housing at opposite lateral sides thereof and communicated with the cavity 140. Each slot 160 outwardly extends to define an L-shaped alleyway 164 on the top wall 130. An inlet 162 is defined between both of the slot 160 and alleyway 164. A swelling118 extends inside each alleyway 164, and a stopper wall 119 is formed next to each slot 160. A pair of mixed latching for locking with the external plug means 110 are located adjacent the slots 160 and consist of a plastic spring bar 112 and a metallic spring buffer 400. Each spring bar 112 is integral with the housing 100 at opposite ends thereof thereby constructing the spring bar 112 as a simple support beam, and divides each slot 160 into a first and second regions (not labeled) in right-and-left directions thereof. Each spring bar 112 further forms a protrusion 116 extending toward the first region of each slot 160, and divide the spring bar 112 into a front and rear portions 1121, 1122.

Figure 4:
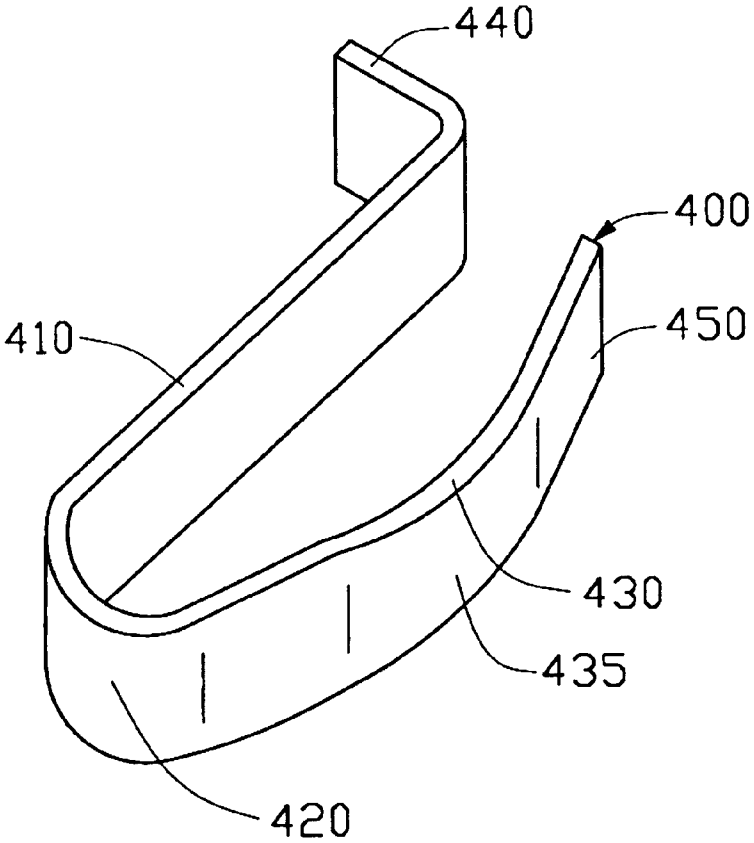
FIG. 4 is an enlarged front perspective view of a spring buffer of the electrical card connector shown in FIG. 2.

Each spring buffer 400 as shown in FIG. 4, includes a planar portion 410, a curved bight portion 420 integrally connected with one of opposite edges of the planar portion 410, a spring arm portion 430 extended out of the planar portion 410 from the bight portion 420, and a tail portion 440 extended from another edge of the planar portion 410 along a direction perpendicular to the inserting direction of the external plug into the housing 100. The spring arm portion 430 is cantilevered and further forms a first supporting section 435 at a central region thereof, and a second supporting section 450 at a distal end thereof.

In assembly as shown in FIGS. 2 & 3, the spring buffer 400 is preloaded by the spring bar 112 of the housing 100 at the spring arm portion 430 and then equipped inside each corresponding slot 160 and alleyway 164. Meanwhile, the first supporting section 435 of the spring arm portion 430 is located at the second region of the slot 160, and sufficiently supports the spring bar 110 by the resiliency of the preloaded spring arm portion 430 within a specific range consisting of the rear portion 1121 and the protrusion 116. Hence, the retentive force between the external plug and the connector 10 is capable of being increased because of a longer force arm. The second supporting section 450 of each spring arm portion 430 is located apart from the corresponding stopped wall 119 of the housing 100. The bight portion 420 of each spring buffer 400 movably extends through the corresponding inlet 162 of the housing 100. The planar portion 410 of each spring buffer 400 abuts against a lateral wall next to the inlet 162 thereby restricting the planar portion 410 from moving along a longitudinal axis of the housing 110. The bent tail portion 440 is impressed by the corresponding swelling 118 to abut against a side wall formed inside the alleyway 164 thereby restricting the tail portion 440 from moving in opposite to the inserting direction of the external plug into the housing 100. It is understandable that the spring buffer 400 can be restricted by the shield 300 (see FIG. 1) from upwardly moving out of the corresponding slot 160 as soon as the shield 300 is firmly secured above the housing 100.

Figure 5:
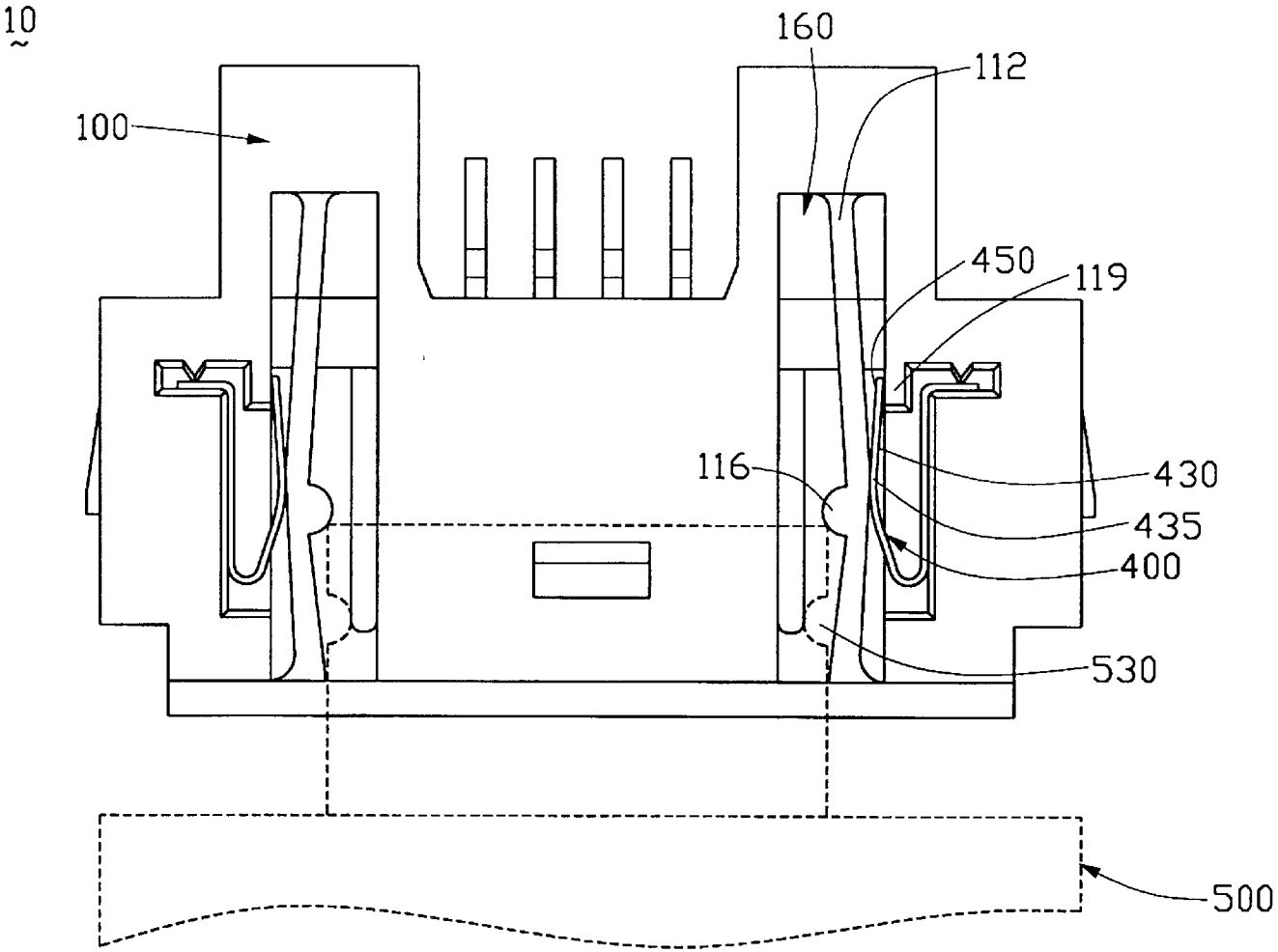
FIGS. 5–6 are successive schemata of the electrical card connector of FIG. 2 showing the inserting process of an external plug into the connector.
Figure 6:
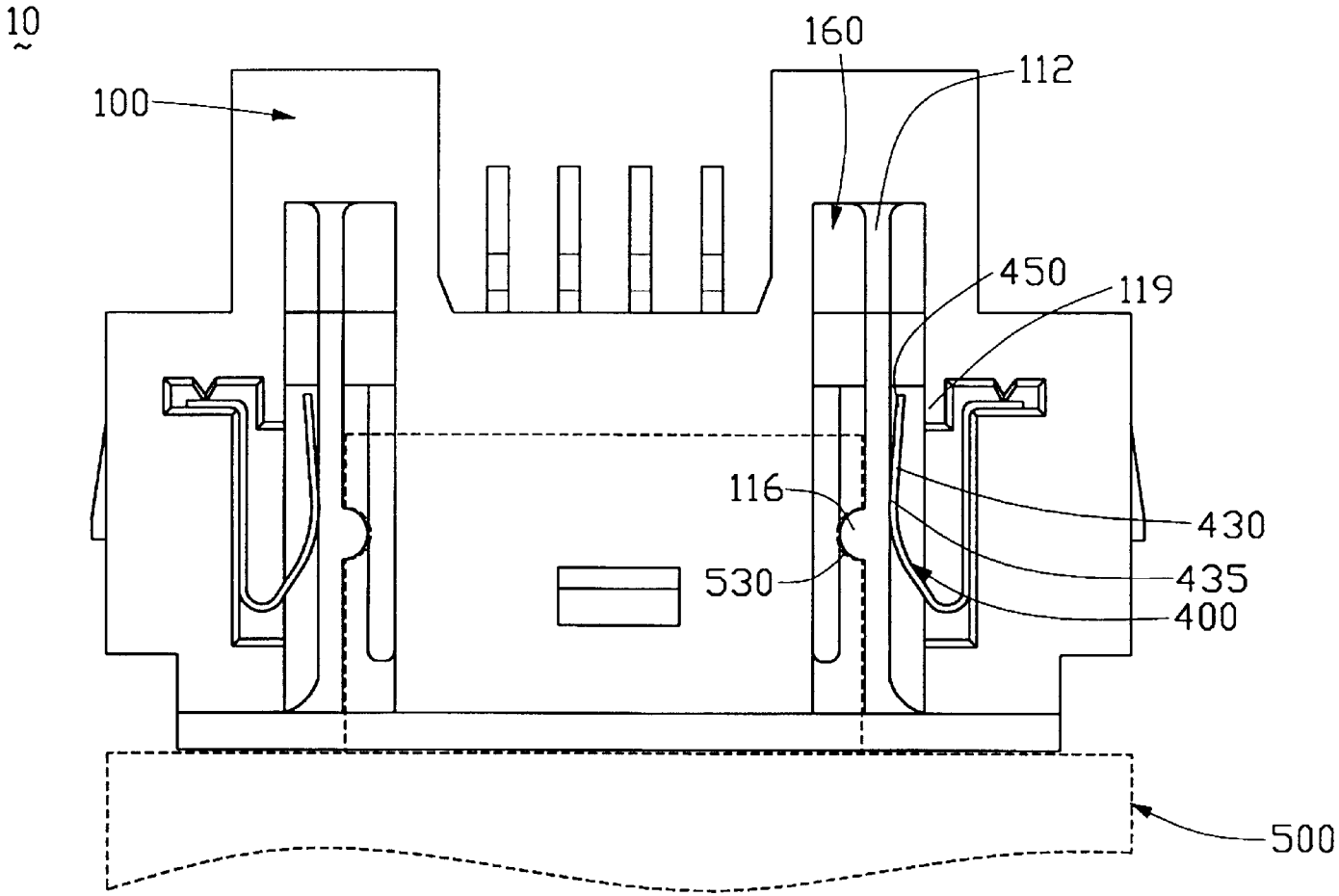

In FIGS. 5 & 6, a simple schema in dotted lines is illustrated to represent the external plug for understanding. In an initial stage of mating with the external plug 500, the protrusion 116 of each spring bar 112 of the housing 100 is engagingly impressed by a mating end of the external plug 500 thereby deforming the spring bar 112 toward the second region of the corresponding slot 160. However, the spring bars 112 are capable of being properly and stably deformed by means of supporting of the resilient force of the preloaded spring arm portions 430, regardless of a thinner or thicker spring bar 112. In the other hand, the spring arm portion 430 of each spring buffer 400 is progressively deflected by way that the first supporting section 435 is relatively impressed until the spring bar is impressed by the insertion of the mating connector into the connector to reach a specific deformation and the second supporting section 450 at the distal end of the spring arm portion 430 abuts against the corresponding stopper wall 119 of the housing 100, as shown in FIG. 5. Hence, the force arm exercised on the spring arm portion 430 in supporting each spring bar 112 is suddenly varied from a cantilevered beam into a simple support beam. A resilient force exercised by the spring arm portion 430 on each spring bar 112 becomes therefore maximized so that the protrusion 116 of the spring bar 112 can suddenly impacts and snap with a notch 530 formed on the plug 500 to create a resounding audio effect. The resounding audio effect is capable of efficiently inspecting the locking status between the electrical card connectors 10 and the plug 500. Then, the spring arm portions 430 are naturally recovered apart away the stopper walls 119 as shown in FIG. 6.

Accordingly, the mixed latching means 110 of the electrical card connector of the present invention is able to keep the spring plastic bar 112 properly deformed by means of supporting of the spring buffer 400 as soon as the electrical card connector 10 is mated with the external plug. Also, a resounding audio effect for ensuring a sufficient retention status between the electrical card connector 10 and external plug is achieved by the variable force arm exercised on the spring arm portion 430 of the spring buffer 400 of the mixed latching means 110. The mixed means 110 functions as varying the latching forces required in different stages of mating with the external plug.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector for mating with an external mating connector, comprising:

an insulative housing with a mating surface, defining at least a slot therein, and an elongated spring bar formed integrally with the housing and extending into the slot and having a protrusion thereon;

a plurality of contacts received within the housing for electrical engagement with the mating connector, each having a soldering tail at a distal end thereof;

a metallic spring buffer disposed inside the housing and including a spring arm portion which pressingly engages the spring bar at a first supporting section of the spring arm portion, a tail portion abutting against a side wall formed adjacent to the slot of the housing thereby restricting the spring buffer from moving, and a bight portion formed between the spring arm portion and the tail portion thereby providing the spring arm portion with a required resiliency whereby as soon as the external mating connector is inserted through the mating surface of the housing to impress the protrusion of the spring bar, the spring bar is properly and stably deformed until the protrusion of the spring bar snap-fits with a notch formed on the mating connector, wherein the spring bar is integrally formed with the housing at opposite ends thereof and divides the slot into first and second regions.

2. The electrical connector as defined in claim 1, wherein a second supporting section formed at a free end of the spring arm portion is spaced apart from a stopper wall formed adjacent to the slot to construct the spring arm portion as being a cantilevered beam.

3. The electrical connector as defined in claim 2, wherein the second supporting section of the spring arm portion abuts against the stopper wall to transform the spring arm portion as a simple support beam when the spring bar progressively impressed by the external mating connector reaches a specific deformation whereby a maximum resilient force is exercised by the spring arm portion on the spring arm to have the protrusion suddenly impact inside the notch so as to create an audio effect.

4. The electrical connector as defined in claim 1, wherein the protrusion of the spring bar divides the spring bar into a front and rear sections, and the first supporting section of the spring arm portion abuts against a specific position within the range consisting of the rear section and the protrusion of the spring bar.

5. The electrical connector as defined in claim 1, wherein the housing further defines an alleyway with a swelling which impresses the tail portion of the spring buffer to abut against the side wall in the alleyway thereby restricting the spring buffer from moving along a direction perpendicular to the inserting direction of the external mating connector into the connector.

6. The electrical connector as defined in claim 5, wherein the housing further defines an inlet interconnecting between the alleyway and the slot thereby permitting the movement of the bight portion of the spring buffer.

7. The electrical connector as defined in claim 1, wherein the spring buffer further has a planar portion connected with the bight portion thereby abutting against a lateral wall adjacent to the housing perpendicular to the tail portion.

8. A mixed latching means for creating an audio effect to inspect the locking status between a connector and a mating connector, comprising:

an elongated spring bar integrally formed at opposite ends thereof with a housing of the connector and having a protrusion thereon;

a metallic spring buffer disposed inside the housing and including a spring arm portion that abuts against the spring bar at a first supporting section of the spring arm portion, a second supporting section formed at the free end of the spring arm portion and spaced apart from a stopper wall formed on the housing to construct the spring arm portion as being a cantilevered beam, a tail portion restricted inside the housing thereby preventing the spring buffer from moving out of the housing, and a bight portion formed between the spring arm portion and the tail portion thereby providing the spring arm portion with a required resiliency; wherein as soon as the spring bar is progressively impressed to reach a specific deformation by means of the insertion of the mating connector into the connector, the second supporting section of the spring arm portion abuts against the stopper wall to transform the spring arm portion as a simple support beam whereby a maximum resilient force is exercised by the spring arm portion on the spring arm to have the protrusion suddenly impact and snap with a notch formed on the mating connector so as to create a resounding audio effect.

9. A method of making a latching means of an electrical connector with regard to an external mating connector, the steps of comprising:

forming an insulative housing including at least a slot defined through an upper wall thereof, an elongated spring bar extending integrally with the housing into the slot and forming a protrusion thereon, and an alleyway adjacent to the slot;

making a metallic spring buffer including a spring arm portion with a free end, a bent tail portion, and a bight portion formed between the spring arm portion and the tai portion for providing the spring arm portion with a required resiliency;

attaching the spring buffer inside the housing under the condition that the spring arm portion is pressingly engaged with the spring bar at a first supporting section of the spring arm portion via the slot, a tail portion is restricted within the alleyway of the housing thereby preventing the spring buffer form moving out of the housing.

10. The method of making a latching means of an electrical connector as defined in claim 9, wherein the step of attaching the spring buffer inside the housing, further includes that the spring buffer is attached therein from the slot defined through the upper wall of the housing.

11. The method of making a latching means of an electrical connector as defined in claim 9, wherein the step of attaching the spring buffer inside the housing, further includes that a shield is covered around the housing thereby preventing the spring buffer from moving out of the housing.

12. The method of making a latching means of an electrical connector as defined in claim 9, wherein the step of attaching the spring buffer inside the housing, further includes that a planar portion formed on the spring buffer abuts against a lateral wall of the housing thereby restricting the spring buffer from moving along a longitudinal axis of the electrical connector.

13. An electrical connector assembly comprising:

a first connector defining an insulative housing with a mating slot therein, an elongated spring bar integrally extending inside the housing by said mating slot along a front-to-back mating direction, a protrusion formed on the spring bar facing to the mating slot;

an auxiliary spring buffer disposed in the housing beside the spring bar opposite to said protrusion, said spring buffer including a spring arm extending in a cantilever type and defining a first supporting section consistently abutting against the spring bar and a second supporting section suspended at a distal free end; and a second connector including a front mating end portion with a notch at a side edge, said mating end portion being inserted into the mating slot with the protrusion received within the notch; wherein when the first and second connectors are initially mated, the mating end portion of the second connector which is dimensioned to have the side edge thereof engage the protrusion, presses the spring bar outwardly so as to have the second supporting section of the spring arm of the spring buffer abut against a portion of the first connector without being suspended any more, thus the spring arm of the spring buffer being changed from a cantilever manner to a simple support manner; when the first and second connector are further deep mated, the protrusion of the spring bar which is configured to comply with the notch of the mating end portion, escapes from the side edge of the mating end portion and is received within the notch thereof so that the spring arm is inwardly sprung back, the second supporting section is relieved from abutment with said portion the first connector, and the spring arm resumes the cantilever manner, whereby the first and second connectors can be mated with each other with a relatively lower insertion/withdrawal force while providing a significant force to create a resounding audio effect at a moment the first and second connectors are fully mated with each other with the protrusion received in the notch.

* * * * *